US005603389A

United States Patent [19]

Zemon

[11] Patent Number: 5,603,389

[45] Date of Patent: Feb. 18, 1997

[54] POLE TOP SAFETY DEVICE

[75] Inventor: David A. Zemon, Parma Hts., Ohio

[73] Assignee: Centerior Energy, Cleveland, Ohio

[21] Appl. No.: 491,019

[22] Filed: Jun. 15, 1995

[51] Int. Cl.[6] ..... E06C 9/04

[52] U.S. Cl. ..... 182/133; 52/40; 52/301; 52/736.4; 116/174; 182/129; 182/230; 248/125.7; 248/219.2

[58] Field of Search ..... 52/40, 65, 125.2, 52/300, 301, 721.5, 723.1, 723.2, 736.1, 736.3, 736.4; 116/173, 174; 182/3, 9, 133, 134, 129, 136, 230; 248/125.7, 125.9, 219.2

[56] References Cited

U.S. PATENT DOCUMENTS

| | | | |
|---|---|---|---|
| 2,072,573 | 3/1937 | Vigliotti | 116/173 |
| 3,006,645 | 10/1961 | Frazier | 182/3 X |
| 3,417,732 | 12/1968 | Platt, Jr. | 116/173 |
| 4,048,779 | 9/1977 | Valenziano et al. | 52/40 X |
| 4,103,642 | 8/1978 | Swenson | 116/174 |
| 4,485,891 | 12/1984 | Friess | 182/9 |
| 5,044,301 | 9/1991 | Peters et al. | 116/173 X |
| 5,373,287 | 12/1994 | Doublet | 116/173 X |

*Primary Examiner*—Carl D. Friedman

*Assistant Examiner*—Kevin D. Wilkens

*Attorney, Agent, or Firm*—Oldham & Oldham Co., LPA

[57] ABSTRACT

A pole top safety device in general comprises a housing including an inner sleeve member dimensioned to fit over the top of the utility pole. A securing mechanism for selectively securing the inner sleeve member onto the utility pole at least at a point below the top of the utility pole. An outer sleeve member is positioned around the inner sleeve member, with the outer sleeve member being rotationally supported on the inner sleeve. The outer sleeve member carries a beam member extending outwardly from the outer sleeve, with the beam member including attachment means at its distal end to which a fall arrest system is selectively attachable. Particularly, the beam member extends radially outward from a position adjacent the utility pole, with the safety device and particularly the inner sleeve and associated outer sleeve being attached to the pole at points both above and below the beam member. The arrangement provides a support structure for a fall arrest system which provides a rated anchor point for a retractable lifeline in compliance with regulatory standards. The device allows rotation of a lifeline 360° around the utility pole with little effort, and is easily installed and removed from a utility pole without extensive setup. The device is also configured to withstand the adverse affects of the outdoor environment.

15 Claims, 2 Drawing Sheets

POLE TOP SAFETY DEVICE

FIELD OF THE INVENTION

The invention relates to a safety device to be fitted atop a pole and used to carry a fall arrest system. The safety device may particularly be mounted on top of a wooden pole such as is used for elevating telephone, cable or power lines. More particularly, the invention provides safety device having a harness beam carrying a fall arrest system, wherein the beam portion extends radially outward from the pole itself, with the harness beam extending from a sleeve member adapted to fit over the top of the pole so that the safety device is attached to the pole and bears upon the pole at points both above and below the beam portion.

BACKGROUND OF THE INVENTION

For many years, utility poles have been used to carry overhead lines or cables typically for supporting power generation, transmission and distribution lines, telephone lines and more recently cable television lines. In order to service the overhead lines, a lineman must ascend the utility pole to perform repairs, with various approaches used to elevate the lineman to the level of the overhead lines. Such approaches have included the use of ladders or lifts mounted on a truck or other vehicle, but in many cases require the lineman to climb the utility pole itself. For safety of the lineman, a fall arrest lanyard may be used by the lineman to strap himself to the utility pole, both to facilitate climbing of the pole as well as providing a safety device.

As utility poles may be of significant height, training of lineman in the climbing of utility poles has been required, with training poles provided at a training site, being of significant height to expose a trainee to possible field conditions. The electric utilities or other companies which may use the utility poles to carry overhead lines are thus faced with the task of training individuals in climbing and operating on such utility poles, and protecting such individuals during training exercises.

More recently, the Occupational Safety and Health Act (OSHA) regulations, have been amended to require that Personal Fall Arrest Systems (PFAS) are required to be used by employees, other than qualified employees, working at elevated locations more than four feet (1.2 m) above the ground. These regulations therefore require that trainees be provided with personal fall arrest systems in association with their utility pole training. Further, in adverse weather conditions, Personal Fall Arrest Systems must be provided for even qualified employees. The OSHA regulations further require that the PFAS shall limit the maximum arresting force on an employee to 900 pounds (4 kN) impact force if used with a body belt, and a maximum of 1800 pounds (8 kN) when used with a body harness. The PFAS shall further not allow free fall more than six feet (1.8 m) or contact with any lower level structures. The PFAS must therefore be anchored with respect to the utility pole, with the anchorage connection specified to be capable of withstanding (without breaking) a 5000 pound load (22.2 kN) per PFAS attached to the anchorage. The anchorage is also specified to provide connection to the PFAS such that it is vertically above the user's head to prevent pendular fall arrest. This can present a problem in that movement around the utility pole is generally required.

While the required Personal Fall Arrest Systems are known and are readily available, no reliable anchorage connection which meets the new OSHA regulations while not inhibiting training methods on utility poles has been developed. The PFAS apparatus generally used to provide fall protection required during training exercises on a utility pole include a retractable lifeline coupled to a body belt or body harness. The retractable lifeline must then be anchored at the top or upper portion of the utility pole, while allowing traditional training methods to be performed by the trainee. Traditional methods of instructing trainees on wood pole climbing require that the PFAS and retractable lifeline associated therewith not become hung up on the pole during maneuvering about the pole during climbing or other operations. Anchoring of the PFAS therefore preferably would be performed from a point outward of the utility pole itself to keep the retractable lifeline away from the pole during maneuvering. The anchoring system in association with the PFAS should also not hinder movement around the utility pole during training or other exercises. The anchoring support for the PFAS must also comply with the OSHA regulations, providing the required anchor point for the retractable lifeline. The required anchoring system for the retractable lifeline should also be easy to install and maintain in association with the utility pole, and should be able to withstand the adverse conditions of the outdoor environment.

SUMMARY OF THE INVENTION

Based upon the foregoing, it is the main object of the invention to provide a safety device which may be positioned at the top of a utility pole to provide an anchor point for a personal fall protection system, which provides a rated anchor point for a retractable lifeline in compliance with regulatory standards.

It is a further object of the invention to provide a pole top safety device which utilizes an outwardly extending harness beam for carrying a fall arrest system, which prevents hanging up of the lifeline on the utility pole during maneuvering up and around the pole.

A further object of the invention is to provide a pole top safety device which supports a retractable lifeline and allows rotation of a lifeline 360° around the utility pole with little effort. The pole top safety device of the invention further is easily installed and removed from a utility pole without extensive setup, and is configured to withstand the adverse affects of the outdoor environment.

The pole top safety device in general comprises a housing including an inner sleeve member dimensioned to fit over the top of the utility pole. A securing mechanism is provided for selectively securing the inner sleeve member onto the utility pole at least at a point below the top of the utility pole. An outer sleeve member is positioned around the inner sleeve member, with the outer sleeve member being rotationally supported on the inner sleeve. The outer sleeve member carries a beam member extending outwardly from the outer sleeve, with the beam member including attachment means at its distal end to which a fall arrest system is selectively attachable. Particularly, the beam member extends radially outward from a position adjacent the utility pole, with the safety device and particularly the inner sleeve and associated outer sleeve being attached to the pole at points both above and below the beam member. The arrangement provides a support structure for a fall arrest system which provides the advantages described above in a strong and durable construction which provides additional safety to the personnel using a fall arrest system in conjunction with climbing utility poles, such as for training exercises or any other situation where a user is working at an elevated height on a utility pole.

BRIEF DESCRIPTION OF THE DRAWINGS

The above and other objects and advantages of the invention will become apparent upon a further reading of the detailed description of a preferred embodiment of the invention in conjunction with the drawings, wherein.

DETAILED DESCRIPTION OF THE INVENTION

Figure 1:
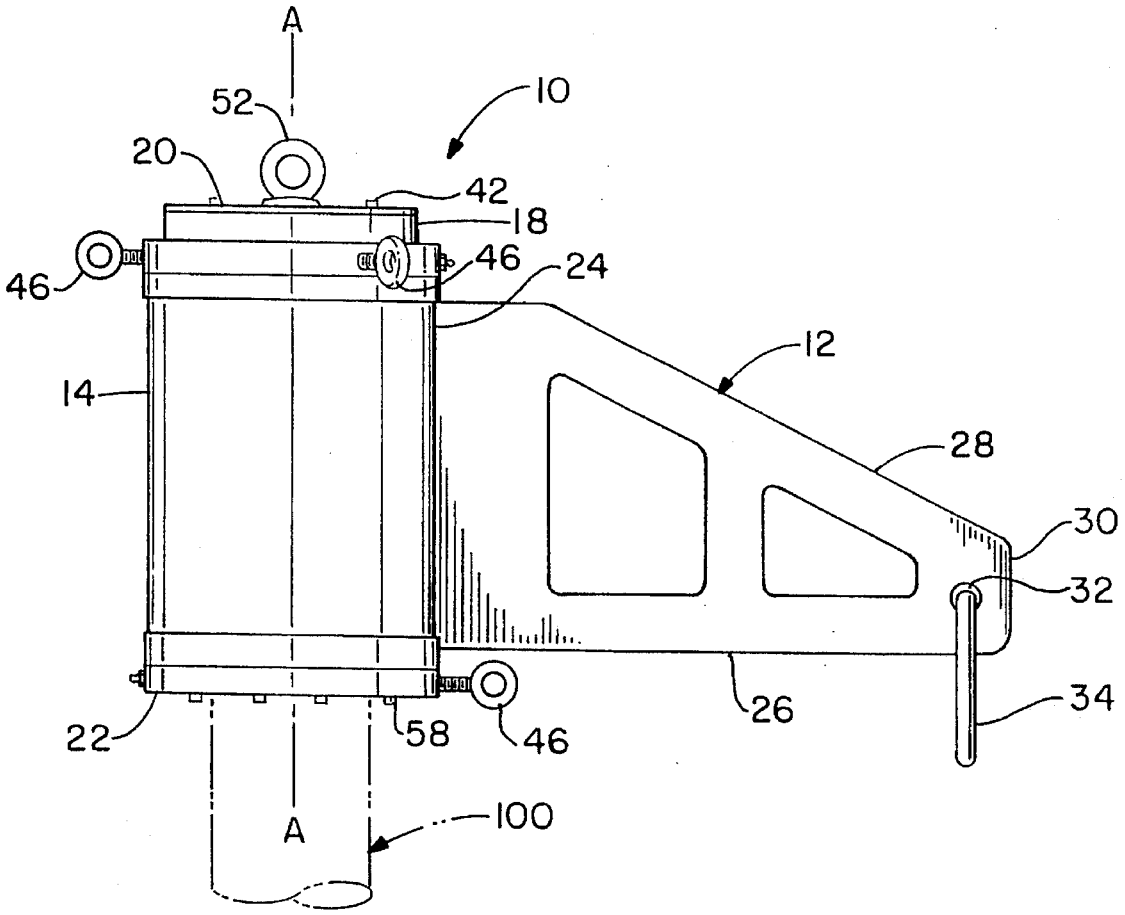
FIG. 1 shows a side elevational view of the pole top safety device in accordance with the invention as mounted on the top of the utility pole.
Figure 2:
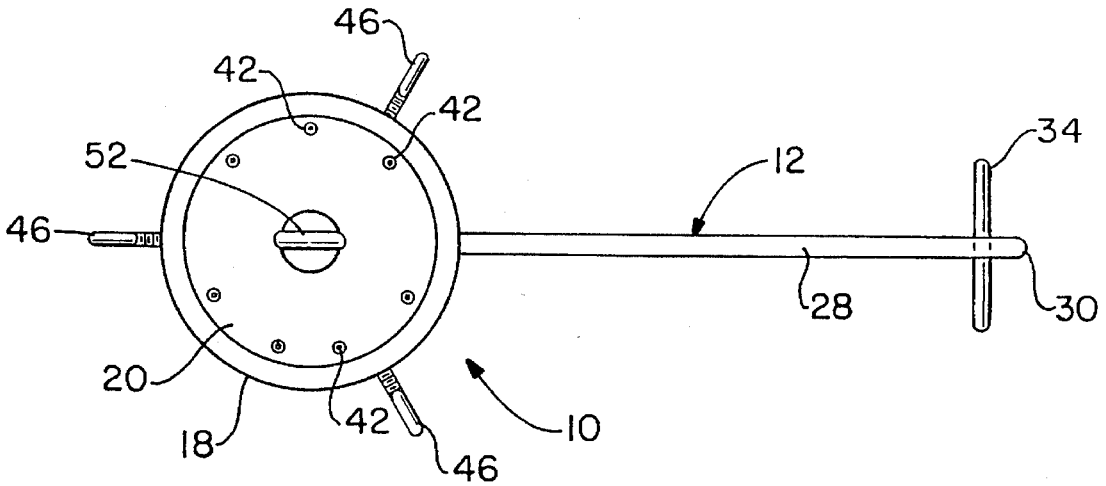
FIG. 2 shows a top view of the safety device as shown in FIG. 1.
Figure 3:
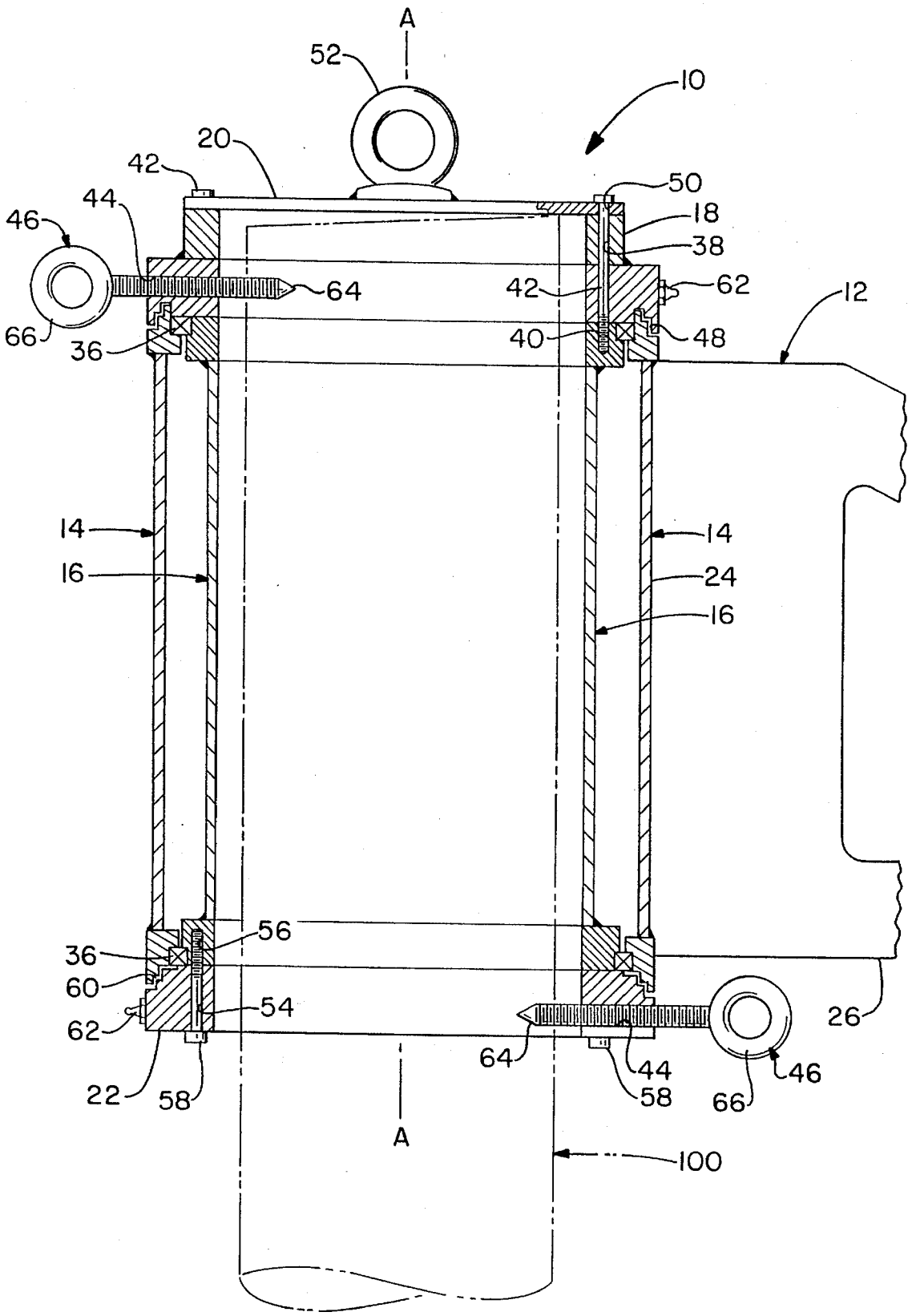
FIG. 3 shows a partial cross-sectional view of the safety device as shown in FIG. 1.

Referring now to the drawings, the pole top safety device 10 in a preferred embodiment of the invention is shown in FIGS. 1 and 2. In FIG. 1, the safety device 10 is mounted on the top of a utility pole 100. As an example, for utility pole training exercises, the pole 100 may be 45 foot, class 3 wood utility pole. In general, utility poles range in diameter between seven to nine inches, and the safety device 10 is configured to adjust so as to accommodate the pole diameter as will become apparent as the description proceeds. Although the description of the preferred embodiment of the invention is described generally with respect to such utility pole, it will be readily understood that the invention may be adapted to be used with other types of utility poles, with device 10 useful with utility poles of different heights, or diameters, or constructed of different materials.

The safety device 10 is fitted directly over the top of the utility pole 100 as shown in FIG. 1, thereby relying upon the significant strength of the pole 100 itself in terms of providing an anchor point of a desired nature. The device 10 generally includes a housing which is positioned on the top of pole 100, with the housing being generally cylindrical to fit around the cylindrical pole 100. A harness beam member 12 extends outwardly from the housing to provide a anchor point at the distal end of the harness beam 12. The housing is formed of an outer sleeve 14 and an inner sleeve 16. The inner sleeve 16 includes an upper securing means or retainer 18 as well as a lower retainer 22, to affix the inner sleeve 16 to pole 100. Both retainers 18 and 22 positively secure inner sleeve 16 to the pole 100, at a position beow the top of the pole 100, such that beam 12 extends radially outwardly from a position adjacent pole 100. A top cap 20 may be provided to enclose the housing at a top portion thereof, substantially preventing the ingress of rain or other precipitation, such that the device 10 can withstand the adverse effects of the outdoor environment in which it is used. As an example, the safety device 10 can be used for training excercises, in which it may be positioned at the top of a utility pole for extended periods of time. To maintain the desired support for a PFAS, the effects of the outdoor environment must be effectively negated. The outer sleeve 14 is thus designed to be generally waterproof, thereby preventing moisture from entering the interior of the housing. Constructing outer sleeve member 14 of a weather resistant material is therefore desirable.

As shown in FIGS. 1 and 2, the beam member 12 may have a generally triangular side profile, with the proximal end 24 thereof being welded or otherwise permanently affixed to the outer sleeve 14. The beam member 12 extends radially outward from the outer sleeve in a direction substantially perpendicular to the axis A of the outer sleeve 14 which substantially coincides with the longitudinal axis of pole 100. The lower surface 26 of beam member 12 may also be perpendicular to the axis A of the outer sleeve 14 (and utility pole 100), while the upper surface 28 is angled with respect to axis A. Beam member 12 may include internal frame members to increase the structural integrity of beam 12, with beam 12 in general providing sufficient strength to comply with the regulatory standards previously mentioned at a minimum, in conjunction with the supporting housing comprising outer and inner sleeves 14 and 16. At a distal end 30 of beam 12, an aperture 32 supports a link member 34 which is provided for attachment to a retractable lifeline PFAS of conventional construction. The retractable lifeline in turn is connected to either a body belt or full body harness worn by the personnel climbing pole 100 to provide the required fall protection for the climber. The link member 34 is free to pivot and rotate relative to hole 32 to allow limited movement of the PFAS relative to the beam member 12.

In the preferred embodiment, beam member 12 extends radially out from pole 100 approximately 30 inches, which substantially prevents any possibility of the lifeline hanging up in device 10 or utility pole 100 during maneuvering by a climber on or around pole 100. The radial length of the beam member 12 is also important to allow a user to fall somewhat clear of the pole 100 should a fall occur, but also to allow the user to readily grasp the pole once the fall is arrested. The length of beam 12 positions the anchorage for the PFAS vertically above the user to prevent pendular fall arrest. The outer sleeve 14 to which beam 12 is affixed preferably has a length somewhat longer than the height of beam 12 at the proximal end 24, such that the outer sleeve 14 extends above and below the beam in its position fixed to sleeve 14. The outer sleeve 14 in general comprises a cylindrical member formed of stainless steel or other metal having high strength, and is provided with upper and lower end pieces which cooperate with mating structures formed in association with inner sleeve 16 as will be described in more detail hereinafter.

The inner sleeve 16 provides the base on which outer sleeve 14 is supported. The inner sleeve is also preferably formed as a cylindrical member fitting over the top of pole 100. The outer sleeve 14 has a diameter to fit around inner sleeve 16, thereby forming a cylinder within a cylinder type of configuration between sleeve members 14 and 16. As with the outer sleeve 14, inner sleeve 16 in the preferred embodiment may comprise a center tube portion with upper and lower annular end pieces designed to mate with a supporting means which in turn supports outer sleeve 14 in coaxial relationship with inner sleeve 16. The outer sleeve 14 is rotationally supported on the inner sleeve 16 as will be hereinafter described, to allow beam member 12 to rotate 360° around pole 100 so as not to inhibit any maneuvering of the user on pole 100. It should be recognized that as the user maneuvers themselves around pole 100, the lifeline attached to their body belt or body harness must move with them. The supporting beam 12 to which the lifeline is attached must therefore also move with the lifeline to ensure that the anchorage point for the lifeline is always directly above the user. the outer sleeve 14 is configured to rotate on the inner sleeve 16, and any rotational movemnt of the user will cause corresponding movement of the outer sleeve 14 and beam member 12 to which the lifeline is attached to via link member 34. In this regard, the rotation of outer sleeve 14 relative to inner sleeve 16 must provide a minimum amount of resistance to rotational forces applied to the harness beam 12. In the preferred embodiment, the resistance to rotation imposed by the arrangement should be less than 5 lbs. of force, allowing beam 12 to follow a user when maneuvering around the utility pole 100 without the retractable lifiline paying out which could cause the lifeline to wrap around the pole 100 during such maneuvering.

To attach device 10 to the pole top, it is desirable to minimize procedures necessary to affix the safety device 10 in the proper position relative to pole 100. Because inner sleeve 16 fits on top of the pole 100 and extends along the sides thereof, set up of device 10 does not require any drilling or shaving of the pole 100 to secure device 10 thereto. The upper retainer 18 and lower retainer 22 therefore carry securing means such as bayonet screws 46, which can be easily screwed into contact with pole 100 to simply affix device 10 thereto in a centered position. A number of screws 46 may be provided in association with upper and lower retainers 18 and 22 respectively to allow inner sleeve 16 to be centered on pole 100 so as to properly level the beam 12 relative to pole 100. Other suitable securing and/or centering mechanisms may be utilized in accordance with the invention if desired. The safety device 10 may also be provided with a lifting eye 52 positioned on top cap 20 to allow connection of rigging associated with a crane or other apparatus to facilitate mounting of device 10 on the pole top. The ability to position the device 10 on the top of the pole 100 in a simplified manner allows quick and easy set up and repositioning of the safety device on any type of pole. Further, positioning of the device 10 on the pole top without any shaving, drilling or other extensive set up procedures to affix the device to the pole makes use of the device simple and convenient.

In the preferred embodiment, the inner sleeve 16, providing the base around which the outer sleeve 14 may rotate, is designed to extend over the top of the pole 100 and to be secured to the circumference of the pole 100 near the top end. As previously indicated, the outer sleeve 14, which supports beam 12, is in turn supported in association with the inner sleeve 16. As an example, the outer sleeve 14 may thus be a cylindrical member having an outside diameter of nominally 12¾" and an inside diameter of nominally 12¼", with annular end pieces positioned at upper and lower ends of the outer sleeve 14. The end pieces may be formed from a short length of tube that is nominally 13" in outside diameter and 11½" in inside diameter prior to machining as will be described hereinafter. Again, depending on the configuration of the pole with which the device is to be used, these dimensions can be readily modified. The outer sleeve 14 is rotationally supported on the inner sleeve 16 by means of a bearing system 36, which is preferably a roller bearing system such as an angular thrust bearing or similar device. The thrust bearing 36 is positioned between the outer sleeve 14 and inner sleeve 16 at both upper and lower positions, such that the inner and outer sleeves are effectively connected to each other through the bearings 36. As an example, the thrust bearing 36 positioned at each end of the outer sleeve 14 may be identical, but for particular applications, it may be preferred to have a heavier duty thrust bearing employed at the lower end of outer sleeve 14. A preferred thrust bearing 36 for this specific embodiment shown in the figures is an 11" outside diameter ball bearing assembly, such as produced by Kaydon Corporation, as part number KD-110-CPO. Such a thrust bearing provides brake-away on rotation at less than 4 lbs. of rotational force being applied in a desired manner. The thrust bearing 36 is disposed between the upper and lower end pieces provided on the outer sleeve 14 and similar end pieces formed in association with the inner sleeve 16. Again merely as an example, the inner sleeve 16 may be configured to fit atop a 7 to 9" diameter utility pole, with an outside diameter of nominally 10", and an inside diameter of 9½". Annular end pieces may be welded or otherwise secured to the inner sleeve 16 at top and bottom portions, with the end pieces typically formed of a short length tube that is nominally 11½" in outside diameter and 9½" in inside diameter prior to machining. Again, depending on the configuration of the pole with which the device is to be used, these dimensions can be readily modified. The thrust bearings 36 may then be disposed between the annular end pieces associated with both the outer sleeve 14 and inner sleeve 16, which are then sealed by the upper and lower retainers 18 and 22.

Both the upper and lower retainers 18 and 22 are annular rings which cover and seal the bearing system 36 between the outer sleeve 14 and inner sleeve 16. The set screws 46 may be provided through radial apertures 44 in the upper and lower retainers 18 and 22 to secure the inner sleeve 16 in a centered position about pole 100. In the embodiment shown, the upper retainer 18 includes a series of angularly spaced, axial apertures 38 which extend through the upper retainer and into the upper end of the inner sleeve 16 to secure retainer 18 thereto. Fastening means 42, such as bolts or the like, may be used to secure the upper retainer 18 to the inner sleeve 16 subsequent to installation of the bearing assembly 36.

In the preferred embodiment, the device 10 is constructed to allow use in the outdoor environment without degradation due to moisture, dirt or other debris causing problems which would inhibit free rotation of the outer sleeve 14 relative to inner sleeve 16 as described. It is therefore particularly important to keep moisture, dirt or debris from affecting functioning of bearing assembly 36. In this respect, the preferred embodiment provides a sealed arrangement between the upper retainer 18 and outer sleeve 14 about the bearing assembly 36. In the preferred embodiment, the upper retainer 18 is machined to form an annular keyway, which cooperates with a mating machined portion of the upper end of the outer sleeve 14. This arrangement forms a labyrinth seal 48 in association with the upper retainer 18, which prevents the ingress of moisture, dirt or other debris. The labyrinth seal 48 is configured such that moisture or debris would have to migrate upwardly to reach the location of the bearing assembly 36, providing an excellent seal for the bearing assembly 36 in association with the upper retainer 18.

The top cap 20 is then provided to completely seal the upper retainer 18 at the top end of the apparatus 10, with cap 20 being secured to the upper retainer 18, such as by bolts 42, extending through corresponding axial apertures 50 provided in the top cap 20. The top cap 20 serves as a shield to the inner surfaces of the annular upper retainer 18 and the inner sleeve 16 from the outside environment in a desired manner. As previously described, a lifting eye 52 can be included which provides a means for attaching the device 10 to a lift such as a crane or the like for raising the device atop the pole 100 to which it is to be attached. It should be recognized that mounting of the device 10 on top of a pole 100 is significantly simplified, as the inner sleeve 16 is dimensioned to accommodate various sized poles 100, to be easily positioned over the top end of the pole without any modification of the pole 100 itself, and without any extensive set up procedures. Once positioned on the top of pole 100, the set screws 46 are used to quickly secure the inner sleeve 16 in a centered positioned relative to pole 100, again without any extensive set up procedures. Set up of device 10 atop of pole 100 can generally be performed in about ten minutes, simplifying use of device 10 and allowing installation and removal to be performed quickly and efficiently.

Similarly to upper retainer 18, the lower retainer 22 functions to cover and seal the lower bearing assembly 36, and to provide securing of the inner sleeve 16 to pole 100. The lower retainer 22 may in turn include a series of angularly spaced, axial apertures 54 which correspond to bores 56 provided in the lower end of inner sleeve 16 to allow blots 58 or other suitable fastening means to be used to secure the lower retainer 22 to the inner sleeve 16. The set screws 46 cooperate with apertures 44 in the lower retainer 22, to allow the lower retainer 22 to be positively secured to the pole 100 in a centered position. In the preferred embodiment, the set screws 46 provided in association with the upper retainer 18 and lower retainer 22 are positioned so that the set screws 46 are diametrically opposed at upper and lower positions, facilitating centering of the device 10 on the pole 100. In the preferred embodiment, the fastening means 46 for securing device 10 atop the pole 100 may be bayonet screws formed from a threaded metal rod, which are easily screwed into engagement with pole 100. For a standard wooden utility pole, the fastening means 46 may include a penetrating end 64 sharpened to a point which will penetrate slightly into the wood of the pole to firmly secure device 10 in position. As the device 10 is positioned such that inner sleeve 16 extends over the top of pole 100, with top cap 20 engaging the top of pole 100, the fastening means 46 do not have to bear significant loads, as any load placed upon the harness beam 12 will be distributed through the outer sleeve 14 and through the bearing assemblies 36 to the inner sleeve 16 and the associated upper and lower retainers 18 and 22.

In the preferred embodiment, the bearing assembly 36 may again be an angular thrust bearing which is sealed in grease. For such an embodiment, the upper retainer 18 and lower retainer 22 may then include an aperture communicating with the exterior of the device 10 and with the respective thrust bearing 36. The outer opening of this aperture may be fitted with a standard grease fitting 62, such as a ⅛" NPT grease fitting, enabling lubrication of the bearing assembly 36 without disassembly of the upper and lower retainers to gain access to the bearing assemblies. As an alternative to a thrust bearing assembly, the bearing assembly may be another type of assembly which will allow rotation of the outer sleeve 14 relative to inner sleeve 16 in the desired manner. For example, bronze or teflon bushings, or other roller or needle bearing assemblies may be used, with again the preferred embodiment desirably obtaining less than 5 lbs. of rotational break away force to cause rotation of the outer sleeve 14 relative to inner sleeve 16.

From the foregoing, it should be recognized that the pole top safety device 10 provides a support for a PFAS at the top of a utility pole which complies with regulatory standards to protect a climber of a utility pole or the like from falling. The device 10 is particularly useful in training exercises, and because it is easily handled may also be used in field situations to protect lineman or other workers in association with such utility poles. The device 10 allows 360° rotation around the utility, pole, and positions the support for the PFAS directly above the user at all times. The device is sealed to withstand the effects of outdoor conditions, and is therefore useable in a variety of environments and conditions without degradation of performance. Although a preferred embodiment of the invention has been described, various midifications would occur to those skilled in the art, and are contemplated in the invention. Accordingly, modifications may be made without departing from the scope to the invention, and it is intended to claim all modifications and variations ads fall with in the scope of the invention as defined in the appended claims.

What is claimed is:

1. A safety device for securing a fall arrest system at an overhead location atop a pole, comprising, a housing including an inner sleeve member dimensioned to fit over the top of the pole, and an outer sleeve member rotatably supported on said inner sleeve member, wherein said outer sleeve member carries a beam member extending outward from said outer sleeve member with said beam member including attachment means to which the fall arrest system is selectively attachable, and said inner sleeve member being a cylindrical member with an open lower end and a top cap member closing the upper end thereof, wherein said top cap member is supported against the top of said pole when said device is positioned on said pole, said inner sleeve member including means to secure said inner sleeve member to said pole such that said beam member extends outwardly from a point adjacent the top of said pole.

2. The device according to claim 1, wherein, said top cap member includes an eye to which a lifting means may be attached for lifting of said device to be positioned on said pole.

3. A safety device for securing a fall arrest system at an overhead location atop a pole, comprising:

a housing including an inner sleeve member dimensioned to fit over the top of the pole, an outer sleeve member rotatably supported on said inner sleeve member, and a sealing means provided between said outer sleeve member and inner sleeve member to prevent the ingress of moisture, dirt or other debris, wherein said outer sleeve member carries a beam member extending outward from said outer sleeve member with said beam member including attachment means to which the fall arrest system is selectively attachable, and said inner sleeve member including means to secure said inner sleeve member to said pole such that said beam member extends outwardly from a point adjacent the top of said pole.

4. The device according to claim 3, wherein, said sealing means comprises a labyrinth seal between said outer sleeve member and said inner sleeve member.

5. A safety device for securing a fall arrest system at an overhead location atop a pole, comprising, a housing including an inner sleeve member dimensioned to fit over the top of the pole, and an outer sleeve member rotatably supported on said inner sleeve member, wherein said outer sleeve member carries a beam member extending outward from said outer sleeve member with said beam member including attachment means to which the fall arrest system is selectively attachable, said inner sleeve member including means to secure said inner sleeve member to said pole, wherein said beam member extends outwardly from a point adjacent the top of said pole, and wherein an upper and a lower retainer are positioned at the top and bottom, respectively, of said outer sleeve member and said inner sleeve member, said upper and lower retainers comprising annular rings which are coupled to said inner sleeve member and rotatably support said outer sleeve member therewith.

6. The device according to claim 5, wherein bearing means are positioned between said outer sleeve member and said inner sleeve member and said upper and lower retainers cover and seal said bearing means between said outer sleeve member and said inner sleeve member.

7. The device according to claim 5, wherein, said securing means are provided in association with said upper and lower retainers.

8. A safety device for securing a fall arrest system at an overhead location atop a pole, comprising, a housing including an inner sleeve member dimensioned to fit over the top of the pole, and an outer sleeve member rotatably supported on said inner sleeve member, wherein said outer sleeve member carries a beam member extending outward from said outer sleeve member with said beam member including attachment means to which the fall arrest system is selectively attachable, said inner sleeve member having a plurality of screw members for engaging said pole so as to center said inner sleeve member about the longitudinal axis of said pole such that the beam member extends outwardly from a point adjacent the top of said pole.

9. In combination with a pole having a length, a safety device for securing a fall arrest system for a climber of the pole at an overhead location on the pole, said safety device comprising:

a housing including an inner sleeve member dimensioned to fit over the top of the pole, and an outer sleeve member rotatably supported on said inner sleeve member, wherein said outer sleeve member carries a beam member extending outward from said outer sleeve member with said beam member including attachment means to which the fall arrest system connectable to said climber is selectively attachable, said inner sleeve member including means to secure said inner sleeve member to the pole along the length thereof such that said beam member extends outwardly from a point along the length of said pole.

10. The device according to claim 9, wherein, said beam member extends substantially perpendicular to said outer sleeve member a predetermined distance, and includes an anchoring point to which said fall arrest system is attached, said anchoring point being positioned a predetermined distance from said outer sleeve member and with respect to said pole.

11. The device according to claim 9, wherein, said outer sleeve member is rotatably supposed with respect to said inner sleeve member such that a rotational force of equal to or greater than 5 pounds will cause rotation of said outer sleeve member relative to said inner sleeve member.

12. The device according to claim 9, wherein, said beam member in association with the device provides an anchorage for a fall arrest system capable of sustaining a static load of at least 5000 pounds.

13. The device according to claim 9, wherein, said outer sleeve member is rotatably supported on said inner sleeve member by bearing means disposed at least between said outer sleeve member and said inner sleeve member at a lower portion thereof.

14. The device according to claim 13, wherein, said bearing means are positioned between said outer sleeve member and said inner sleeve member at both upper and lower portions thereof.

15. The device according to claim 13, wherein, said bearing means comprises an angular thrust roller bearing assembly.

* * * * *